US010246815B2

(12) United States Patent
Date

(10) Patent No.: US 10,246,815 B2
(45) Date of Patent: Apr. 2, 2019

(54) STEAM IRON HEAD

(71) Applicant: KONINKLIJKE PHILIPS N.V., Eindhoven (NL)

(72) Inventor: Milind Vishwas Date, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/504,700

(22) PCT Filed: Jul. 30, 2015

(86) PCT No.: PCT/EP2015/067498
§ 371 (c)(1),
(2) Date: Feb. 17, 2017

(87) PCT Pub. No.: WO2016/030122
PCT Pub. Date: Mar. 3, 2016

(65) Prior Publication Data

US 2017/0268162 A1 Sep. 21, 2017

(30) Foreign Application Priority Data

Aug. 26, 2014 (EP) ..... 14182183

(51) Int. Cl.
*D06F 75/12* (2006.01)
*D06F 75/38* (2006.01)
*D06F 75/18* (2006.01)

(52) U.S. Cl.
CPC ..... *D06F 75/12* (2013.01); *D06F 75/38* (2013.01)

(58) Field of Classification Search
CPC ..... D06F 75/02; D06F 75/06; D06F 75/08; D06F 75/10; D06F 75/12; D06F 75/20;
(Continued)

(56) References Cited

U.S. PATENT DOCUMENTS 1,065,873 A * 6/1913 Kako ..... D06F 75/12 38/77.6
1,347,224 A * 7/1920 Kako ..... D06F 75/12 38/77.2

(Continued)

FOREIGN PATENT DOCUMENTS

EP 2251482 A1 11/2010
EP 2746460 A2 6/2014
WO 2004061192 A1 7/2004

*Primary Examiner* — Ismael Izaguirre

(57) ABSTRACT

The present application relates to a steam iron head (30). The steam iron head (30) has a steam inlet (36), a steam pathway (40), and at least one steam vent through which steam is discharged from the steam iron head. The steam pathway (40) has a first steam flow section (50) and a second steam flow section (60). The first steam flow section (50) defines an indirect flow path between the steam inlet (36) and a second steam flow section (60). The second steam flow section (60) defines a cyclonic flow path between the first steam flow section (50) and the at least one steam vent. The present application also relates to a steam system iron (10) having a steam iron head (30). This invention helps remove any water droplets, for example formed by condensation, from the steam flow passing through the steam iron head from the steam inlet to the at least one steam vent.

12 Claims, 5 Drawing Sheets

(58) Field of Classification Search
CPC ..... D06F 75/24; D06F 75/38; D06F 75/18; B01D 1/00; B01D 1/0011; B01D 1/0064; B01D 1/02; B01D 1/06; B01D 1/14; B01F 3/02; B01F 3/04; F28B 1/00; F28B 1/06
See application file for complete search history.

(56) References Cited

U.S. PATENT DOCUMENTS

| | | | | | |
|---|---|---|---|---|---|
| 1,516,923 | A | * | 11/1924 | Hoffman | D06F 75/06 38/77.9 |
| 1,674,092 | A | | 6/1928 | Brewer | |
| 2,160,421 | A | * | 5/1939 | Sebo | D06F 75/12 38/77.6 |
| 3,414,993 | A | * | 12/1968 | Naomoto | D06F 75/06 38/77.6 |
| 4,594,800 | A | | 6/1986 | Herrmann | |
| 2012/0042547 | A1 | * | 2/2012 | Pang | D06F 75/20 38/77.6 |

* cited by examiner

STEAM IRON HEAD

This application is the U.S. National Phase application under 35 U.S.C. § 371 of International Application No. PCT/EP2015/067498, filed on Jul. 30, 2015, which claims the benefit of International Application No. 14182183.5 filed on Aug. 26, 2014. These applications are hereby incorporated by reference herein.

FIELD OF THE INVENTION

The present invention relates to a steam iron head. The present invention also relates to a steam system iron having a steam iron head.

BACKGROUND OF THE INVENTION

Steam irons are used to remove creases from fabric, such as clothing and bedding. Steam system irons typically have a base unit with a steam generator for converting water into steam, a steam iron head from which steam is discharged, for example towards a fabric, and a flexible hose through which steam is fed from the base unit to the steam iron head. The steam iron head typically comprises a body with a handle, so a user can manoeuvre the steam iron, and a soleplate which is placed in contact with the fabric to be ironed. Steam is discharged through steam vents in the soleplate. The soleplate is heated to aid the removal of creases when ironing the fabric.

It is known for steam to condense when travelling from the steam generator to the steam vents through which steam is discharged, for example when passing through the hose. The condensed water may be released from the steam vents, which is known as spitting. This spitting may create wet spots and staining on a fabric to be treated.

SUMMARY OF THE INVENTION

It is an object of the invention to provide a steam iron head which substantially alleviates or overcomes the problems mentioned above.

The invention is defined by the independent claims; the dependent claims define advantageous embodiments.

According to one aspect of the present invention, there is provided a steam iron head having a steam inlet, a steam pathway having a first steam flow section and a second steam flow section, and at least one steam vent through which steam is discharged from the steam iron head, wherein the first steam flow section defines an indirect flow path between the steam inlet and a second steam flow section, and the second steam flow section defines a cyclonic flow path between the first steam flow section and the at least one steam vent.

This invention helps remove any water droplets, for example formed by condensation, from the steam flow passing through the steam iron head from the steam inlet to the at least one steam vent. Therefore, water droplets are restricted from passing from the at least one steam vent and coming into contact with a fabric. By providing an indirect steam path, steam passing along the first steam flow section is forced to deviate from the direction of flow. Heavier water droplets in the flow therefore impinge on the surface of the first steam flow section and are distributed as smaller water droplets. These smaller water droplets may be more easily evaporated. Water droplets in contact with a surface of the first steam flow section may be evaporated by the heat of the surface. By providing a cyclonic steam path, any remaining water droplets are centrifugally urged against a peripheral side wall of the second steam flow section. These may be smaller water droplets formed in the first steam flow section. Water droplets in contact with a surface of the second steam flow section may be evaporated by the heat of the surface.

The steam iron head may further comprise a heater configured to heat the steam pathway. With this arrangement it is possible to easily provide heat to the steam pathway. This provides for surfaces of the steam pathway to be heated such that water droplets coming into contact with the surfaces are evaporated into steam.

The heater may be configured to maintain the steam pathway at a temperature at least above 100° C. (i.e. equal to or greater than 100° C.).

This helps to ensure that water droplets coming into contact with the surfaces are evaporated into steam.

The first steam flow section may have a labyrinth configuration.

The labyrinth configuration of the steam passageway guides steam on a pre-defined path. The labyrinth configuration also forces steam to change direction which causes collisions between the surfaces defining the steam passageway and water droplets in the steam flow. In these collisions the water may be distributed into smaller water droplets, and heat may be transferred to the water droplets from the surfaces. This encourages heat transfer and evaporation of the water droplets.

The steam iron head may further comprise a baffle extending in the first steam flow section configured to form the labyrinth configuration. Therefore, the labyrinth configuration may be easily formed.

The baffle may be at least one sidewall upstanding from a base wall of the first steam flow section. With this arrangement, heat energy from the heater may be easily transferred to the or each sidewall. Furthermore, condensation in the steam pathway may be minimised.

The second steam flow section may comprise a cyclonic chamber. Therefore, a vortex may be simply generated along the steam path. The cyclonic chamber may comprise a base and a frusto-conical peripheral side wall extending from the base. With this arrangement, the velocity of the steam flow increases towards an upper end of the cyclonic chamber, distal to the base. Therefore, the centrifugal force of the steam flow may be maximised in the second steam flow section, which helps to minimise water droplets passing from the second steam flow section. The cyclonic chamber also provides a passive solution which is operational whenever there is a steam flow. A cyclonic chamber is also able to separate the fluids at high velocity.

The steam pathway may be configured so that steam enters the cyclonic chamber in a direction orientated about 5 degrees to the base. This arrangement helps to generate a helical steam path in the cyclonic chamber and so aid the flow of steam towards the upper end of the cyclonic chamber.

A cyclonic chamber outlet may be provided on the longitudinal axis of the cyclonic chamber. The cyclonic chamber outlet may be disposed proximate the upper end of the cyclonic chamber. A conduit may upstand in the cyclonic chamber. The cyclonic chamber outlet may be defined by the conduit, distal to the cyclonic chamber inlet. The cyclonic chamber outlet may be defined by a free end of the conduit. Therefore, removal of water droplets from the steam flow may be maximised. By providing the conduit, the flow path from the cyclonic chamber to the at least one steam vent may be simplified. Furthermore, the cyclonic chamber outlet may be provided at the upper end of the cyclonic chamber, therefore helping to maximise the efficiency of the second steam flow section at removing water droplets from steam flow.

The steam iron head may further comprise a cyclonic chamber inlet configured to direct steam tangentially into the cyclonic chamber. This tangential inlet may help to produce a swirling motion and so maximise the centrifugal force acting on water droplets in the steam flow.

The steam iron head may further comprise an intermediate steam flow section between the first steam flow section and the second steam flow section. At least part of the intermediate steam flow section may have a flow area which is less than the flow area of the first steam flow section. With this arrangement, the velocity of steam flow entering the second steam flow section is greater than the velocity of steam flow in the first steam flow section. This helps to maximise the centrifugal force applied to the steam flow in the second steam flow section.

The steam iron head may further comprise an outlet steam flow section between the second steam flow section and the at least one steam vent.

With this arrangement, steam may be simply provided to the at least one steam vent.

According to another aspect of the present invention, there is provided a steam system iron comprising the steam iron head according to any one of claims 1 to 13.

The steam system iron may further comprise a base unit having a steam generator and a hose fluidly communicating the steam iron head with the steam generator.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
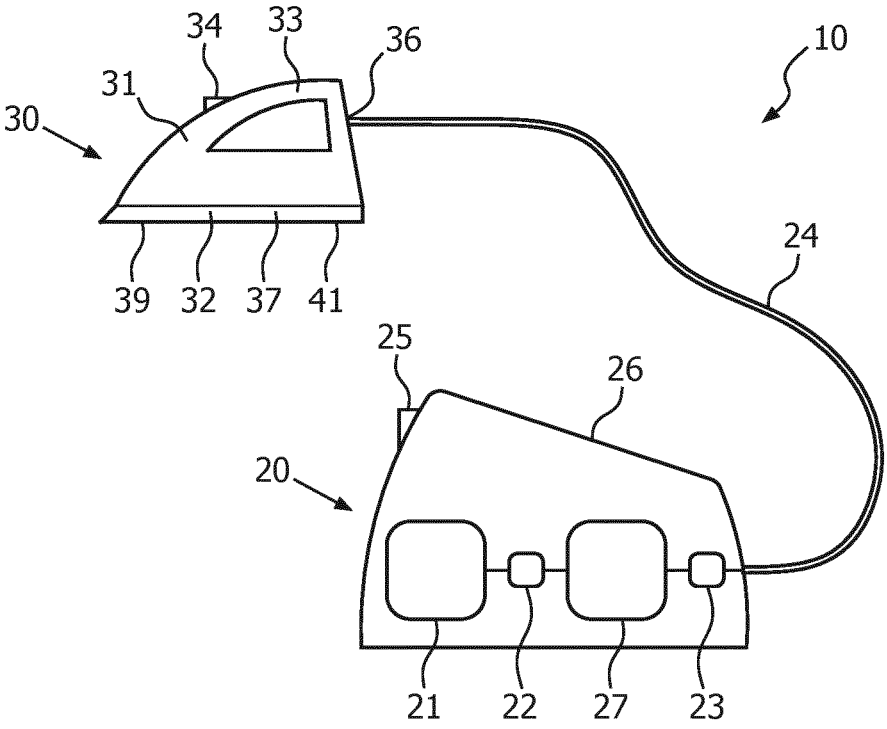
FIG. 1 is a schematic perspective view of a steam system iron having a steam iron head according to the present invention.

A steam system iron 10, acting as a steam device, is shown in FIG. 1 comprising a base unit 20 and a steam iron head 30. The steam system iron 10 is configured to generate steam to be emitted against a fabric to be treated. Although the invention will be described herein by reference to a steam system iron, it will be understood that alternative arrangements are envisaged. For example, the steam device may be a handheld steam iron, a garment steamer or a wallpaper steamer.

The base unit 20 has a steam generator 27. A water reservoir 21 in the base unit 20 holds water to be converted into steam. A pump 22 is provided to supply water from the water reservoir 21 to the steam generator 27. A valve 23 is provided to control the flow of steam from the steam generator 27. The base unit 20 fluidly communicates with the steaming head 30 via a hose 24. The hose 24 is configured to allow the flow of steam from the base unit 20 to the steam iron head 30. The hose 24 communicates with the steam generator 27 via the valve 23. The hose 24 includes a tube (not shown) forming a path along which steam is able to flow. The hose 24 may also include, for example, at least one communication cable (not shown) along which electrical power and/or control signals may be sent between the base unit 20 and the steam iron head 30. The base unit 20 also includes a power supply unit (not shown) for supplying power to components of the steam system iron 10. A base user input 25 is on the base unit 20 for controlling operation of the steam system iron 10. The base unit 20 also has a stand 26 for receiving the steam iron head 30. A controller (not shown) is configured to control operation of the steam system iron 10.

Although the steam generator 27 is in the base unit 20 in the present embodiment, it will be understood that the arrangement of the base unit 20 may differ. For example, the steam generator 27 may be in the steam iron head 30. In such an arrangement, the hose 24 may supply water from the base unit 20 to the steam iron head 30. Alternatively, the water reservoir 21 may be in the steam iron head 30, and the base unit 20 omitted.

The steam iron head 30 has a body 31 and a soleplate 32. The soleplate 32 defines a lower end of the steam iron head 30. The body 31 comprises a handle 33. The handle 33 enables a user to hold and manoeuvre the steam iron head 30. A user input 34 is on the body 31 for operating the steam system iron 10. Steam is provided to the steam iron head 30 via the hose 24. The steam iron head 30 comprises a steam inlet 36 through which steam is supplied to the steam iron head 30. The supply of steam to the steam iron head 30 is controlled by the base unit 20, however, it will be understood that the steam iron head 30 may have a steam feed unit to control the mass-flow of steam from the steam iron head 30.

The steam iron head 30 has steam vents (not shown) through which steam flows from the steam iron head 30 to be provided to a fabric, for example. The steam vents are in the soleplate 32. A steam pathway 40 (refer to FIG. 2) is defined from the steam inlet 36 to the steam vents. The soleplate 32 has a soleplate panel 37. The soleplate panel 37 defines the steam pathway 40. The soleplate panel 37 has a main body 38 (refer to FIG. 2). The soleplate panel 37 also has an ironing plate 39. The ironing plate 39 defines a fabric contact surface 41. The steam vents extend through the ironing plate 39. The fabric contact surface 41 is configured to be positioned against a fabric to be treated. The steam vents are formed to open to the steam contact surface 41. The fabric contact surface 41 is planar.

The ironing plate 39, defining a lower side of the soleplate panel 37 defines the fabric contact surface 41. The soleplate panel 37 is formed from a heat conductive material, for example aluminium. The soleplate panel 37 is formed from a plurality of layers, for example in the present embodiment the main body 38 and ironing plate 39 are mounted together, and the ironing plate 39 has a non-stick layer (not shown). The soleplate panel 37 may be formed from a single layer. The soleplate panel 37 has at least one chamber or pathways defined therein. It will be understood that the number of steam vents (not shown) may vary. One steam vent may be present, or a plurality of steam vents may be distributed along the fabric contact surface 41. The soleplate 32 also has a cover 42 (refer to FIG. 3). The cover 42 defines an upper end of the soleplate 32. The cover 42 is mounted to the main body 38 of the soleplate panel 37. It will be understood that the soleplate panel 37 and cover 42 may be integrally formed.

A heater (not shown) is received in the soleplate panel 37. In the present embodiment the heater is embedded in the main body 38. The heater extends longitudinally along the soleplate panel 37. The heater has a U-shaped arrangement with the apex of the heater disposed proximal to a front end of the steam iron head 30. The heater is substantially internally received in the soleplate panel 37. The heater conducts heat to the soleplate panel 37, when operated. It will be understood that the arrangement of the heater may differ.

Figure 2:
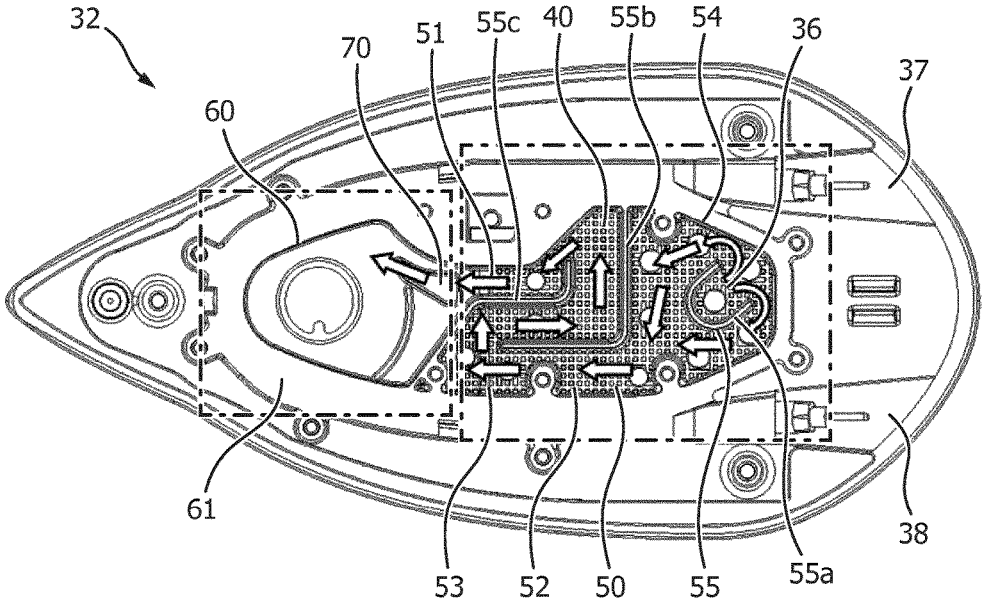
FIG. 2 is a diagrammatic plan view of a soleplate of the steam iron head shown in FIG. 1 with a cover of the soleplate omitted according to the present invention.
Figure 3:
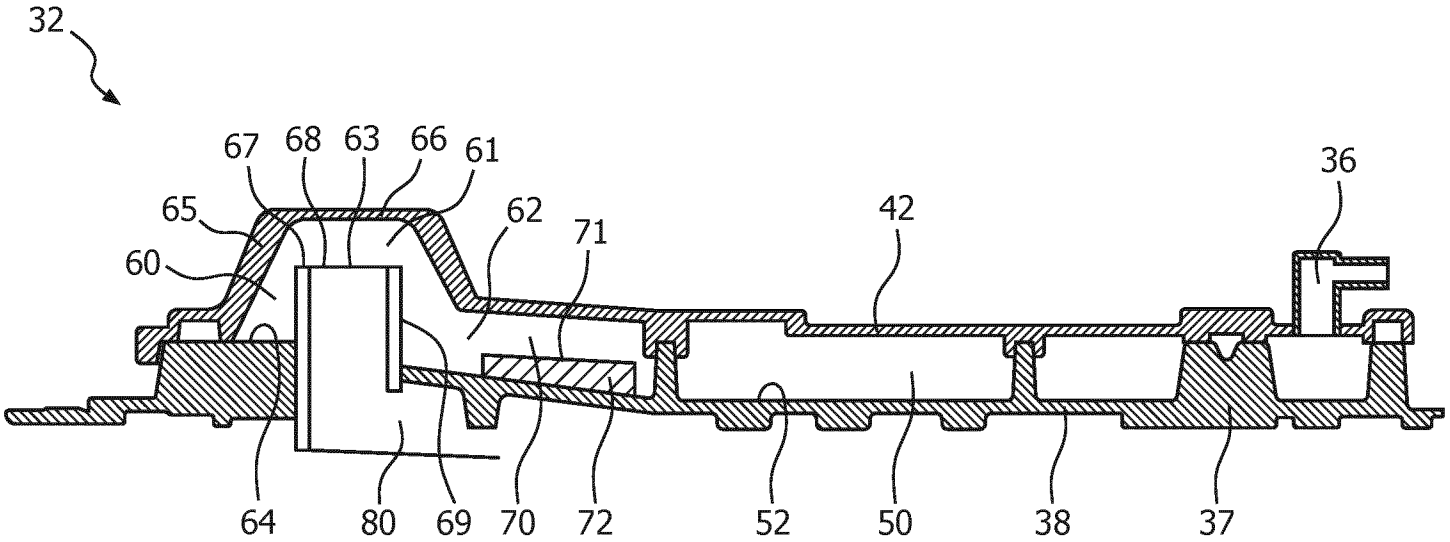
FIG. 3 is a diagrammatic cut-away side view of the soleplate shown in FIG. 2 with the cover included according to the present invention.
Figure 4:
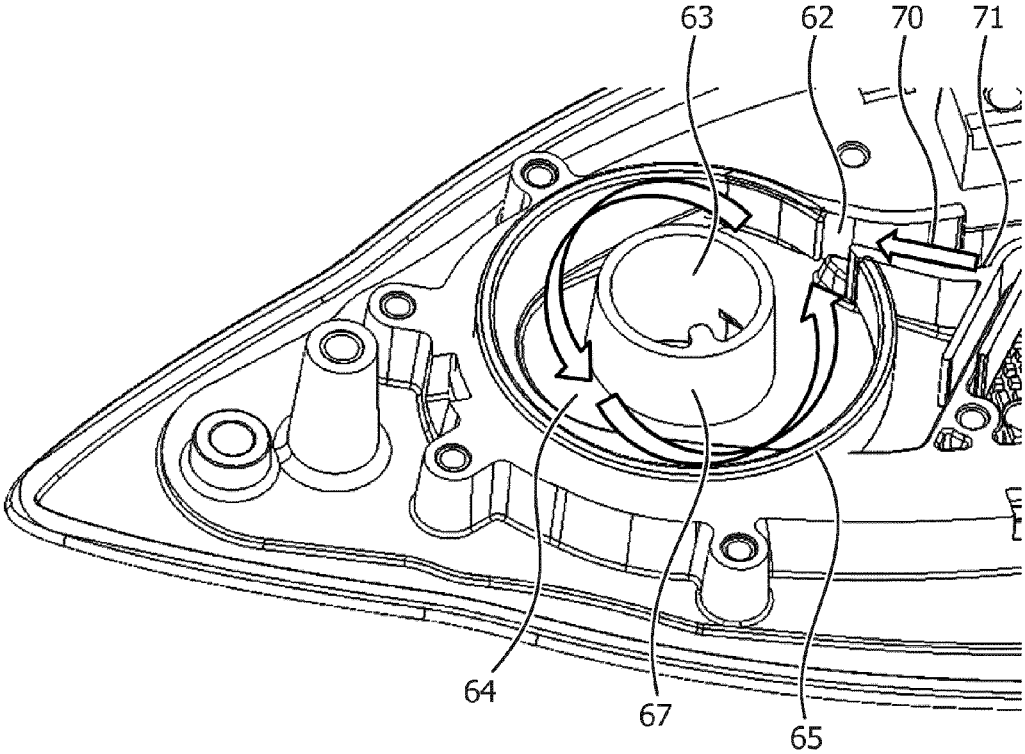
FIG. 4 is a diagrammatic cut-away perspective view of part of the soleplate shown in FIG. 2 with part of the cover omitted according to the present invention.
Figure 5:
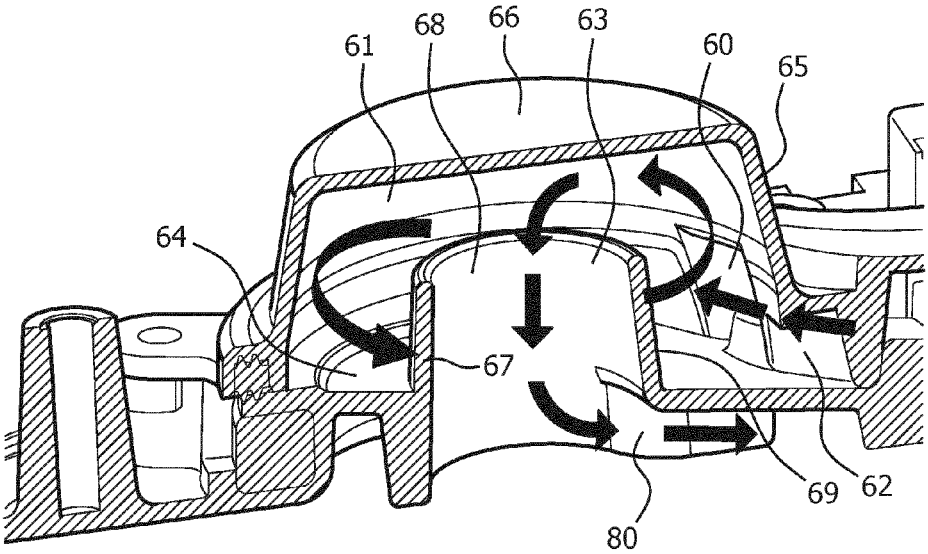
FIG. 5 is a diagrammatic cut-away side view of part of the soleplate shown in FIG. 2 according to the present invention.

Referring to FIGS. 2 and 3, the soleplate 32 of the steam iron head 30 is shown. FIG. 2 shows the soleplate 32 of the steam iron head 30 with the cover 42 omitted. The soleplate 32 defines the steam pathway 40. The steam pathway 40 extends from the steam inlet 36 to the steam vents (not shown). Therefore, steam flows into the steam iron head 30 through the steam inlet 36, flows along the steam pathway 40 and flows from the steam iron head 30 through the steam vents. The soleplate 32 is formed from, for example, but not limited to aluminium or magnesium alloys.

The steam pathway 40 comprises a first steam flow section 50 and a second steam flow section 60. The first steam flow section 50 is defined between the steam inlet 36 and the second steam flow section 60. The second steam flow section 60 is defined between the first steam flow section 50 and the steam vents (not shown). A linking passage 70, acting as an intermediate steam flow section, communicates between the first steam flow section 50 and the second steam flow section 60. The linking passage 70 may be omitted. An outlet passage 80, acting as an outlet steam flow section, communicates between the second steam flow section 60 and the steam vents (not shown). The outlet passage 80 may be omitted.

The steam inlet 36 comprises a pipe. The steam inlet 36 fluidly communicates with the hose 24, such that steam flowing along the hose 24 is provided to the steam inlet 36. The steam inlet 36 communicates with the first steam flow section 50 of the steam pathway 40. The steam inlet 36 communicates with the first steam flow section 50 at one end of a steam path defined by the first steam flow section 50. A first steam flow section outlet 51 is at the other end of the steam path defined by the first steam flow section 50.

The first steam flow section 50 comprises a base wall 52 and sidewalls 53. The sidewalls 53 comprise an outer sidewall 54 and internal sidewalls 55. The internal sidewalls 55 act as baffles to direct the fluid flow through the first steam flow section 50. Three internal sidewalls 55, a first sidewall 55*a*, second sidewall 55*b*, and third sidewall 55*c*, are shown in FIG. 2, although it will be understood that the number and configuration of the internal sidewalls 55 may vary dependent on the desired flow path through the first steam flow section 50.

The outer sidewall 54 defines the maximum extent of the first steam flow section 50 and forms a flow chamber through which steam is able to flow. The outer sidewall 54 acts as a baffle to direct the fluid flow through the first steam flow section 50. It will be understood that the configuration of the outer sidewall 54 may vary dependent on the desired flow path through the first steam flow section 50.

The outer sidewall 54 extends from the base wall 52. The base wall 52 and outer sidewall 54 are formed by the main body 38 of the soleplate panel 37. The internal sidewalls 55 extend from the base wall 52. The internal sidewalls 55 are formed by the main body 38 of the soleplate panel 37. In the present embodiment, the sidewalls 53 are integrally formed with the soleplate panel 37, however it will be understood that the configuration may vary. The sidewalls 53 extend from the base wall 52 to help maximise heat conduction to the sidewalls 53 from the heater. This helps to ensure that the sidewalls 53 are heated.

The base wall 52 and sidewalls 53 form steam contact walls of the first steam flow section 50. The corresponding part of the cover 42 also forms a steam contact wall of the first steam flow section 50. Surfaces of the base wall 52 and sidewalls 53 form steam contact surfaces. The corresponding part of the cover 42 also forms a steam contact surface.

In the present embodiment, steam flows into the first steam flow section 50 of the steam pathway 40 via the steam inlet 36. Steam flows from the first steam flow section 50 through the first steam flow section outlet 51. In the present embodiment, the first steam flow section outlet 51 is formed in the outer sidewall 54. The first steam flow section outlet 51 is spaced from the steam inlet 36. The sidewalls 53 direct the fluid flow from the steam inlet 36 to the first steam flow section outlet 51.

The flow path defined in the first steam flow section 50 of the steam pathway 40 is an indirect flow path. That is, fluid flowing along the flow path must change direction at least once as it passes along the flow path. This helps cause a collision of fluid flowing along the flow path with at least one sidewall 53. In the present embodiment, the flow path defined in the first steam flow section 50 has a labyrinth configuration. That is, fluid flowing along the flow path must make multiple changes in direction as it flows along the flow path from the steam inlet 36 to the first steam flow section outlet 51. This helps cause multiple collisions of fluid flowing along the flow path with sidewalls 53. The internal side walls 55, acting as baffles, direct the flow of steam through the first steam flow section 50.

Preferably, the first steam flow section is bounded on two sides by the heater. The temperature control sensor is located adjacent to the first steam flow section. The general thickness of the base 37 is preferred between 1 to 2.5 mm to maximise the heat flow to the steam flow section.

Preferably, the floor of the labyrinth area is of grid structure to facilitate the water evaporation. The labyrinth baffles are connected to the cover 42 with sealing means. The cover 42 is preferred to be made from aluminium of general thickness 1.0 mm to 2 mm.

The first internal sidewall 55*a* extends partially around the steam inlet 36. The steam inlet 36 communicates through the cover 42, although alternative arrangements are possible. The first internal sidewall 55*a* is U-shaped. The first internal sidewall 55*a* forms a multicursal arrangement, that is forming multiple flow branches in the first steam flow section 50. The second internal sidewall 55*b* is L-shaped. The second internal sidewall 55*b* forms a unicursal arrangement, that is forming a single flow branch in the first steam flow section 50. The third internal sidewall 55*c* is also L-shaped. The third internal sidewall 55*c* extends to the first steam flow section outlet 51.

The arrangement of the first steam flow section 50 may vary. The first steam flow section 50 causes multiple changes in direction to fluid flowing along the flow path. By providing an indirect steam path, the direction of flow of steam passing along the first steam flow section is forced to deviate. Heavier water droplets in the flow are more resistant to deviations in flow direction and therefore impinge against the sidewalls 53 of the first steam flow section 50 and are dispersed as smaller water droplets. These smaller water droplets may be more easily evaporated. Water droplets in contact with a surface of the sidewalls 53 of the first steam flow section 50 may be evaporated by the heat of the surface.

The second steam flow section 60 comprises a cyclonic chamber 61. The cyclonic chamber 61 acts as a fluid separator. The cyclonic chamber 61 has a cyclonic chamber inlet 62 and a cyclonic chamber outlet 63. Steam from the first steam flow section 50 flows into the cyclonic chamber 61 through the cyclonic chamber inlet 62. The cyclonic chamber inlet 62 communicates with the linking passage 70.

The linking passage 70, acting as an intermediate steam flow section, communicates between the first steam flow section 50 and the second steam flow section 60. The linking passage 70 extends from the first steam flow section outlet 51 and the cyclonic chamber inlet 62. The linking passage 70 has a linking passage base 71. The linking passage base 71 is defined by a stepped portion 72. The stepped portion 72 is stepped from the base wall 52 of the first steam flow section 50. Therefore, the flow area of the linking passage 70 is less than the flow area of the first steam flow section 50. It will be understood that the reduction in flow area may be achieved by alternative arrangements. The reduction in flow area at the linking passage 70 causes a restriction at the cyclonic chamber inlet 62. The restriction increases the velocity of steam flow. The linking passage 70 is inclined relative to the first steam flow section 50. The linking passage base 71 is inclined relative to the base wall 52 of the first steam flow section 50. In the present embodiment, the incline is about 5 degrees. The incline causes the steam flow entering the cyclonic chamber 61 to follow a helical path. The steam flow therefore enters the cyclonic chamber at a non-perpendicular angle to the longitudinal axis of the cyclonic chamber 61.

The cyclonic chamber 61 has a base 64 and a peripheral sidewall 65. The peripheral sidewall 65 extends from the base 64. The peripheral sidewall 65 converges from the base 64. The cyclonic chamber 61 forms a substantially frusto-conical shape. A top wall 66 of the cyclonic chamber 61 faces the base 64. The cyclonic chamber inlet 62 is disposed proximate to a lower end of the cyclonic chamber 61. The cyclonic chamber inlet 62 is formed at the peripheral sidewall 65. The cyclonic chamber inlet 62 is configured to guide steam flow to enter the cyclonic chamber 61 tangentially. In the present embodiment, the peripheral sidewall 65 and top wall 66 are formed by the cover 42. The surfaces of the cyclonic chamber 61 are heated by heat conducted through the soleplate 32 from the heater (not shown).

The cyclonic chamber outlet 63 is disposed proximate to an upper end of the cyclonic chamber 61. A conduit 67 extends in the cyclonic chamber 61. In the present embodiment, the conduit 67 is a tube. The conduit 67 upstands in the cyclonic chamber 61 and extends from the base 64. The conduit 67 defines the cyclonic chamber outlet 63. This arrangement provides for steam exiting from the cyclonic chamber 61 to be simply supplied to the steam vents (not shown). The conduit 67 extends along the longitudinal axis of the cyclonic chamber 61. A free end 68 of the conduit 67 is proximate to the upper end of the cyclonic chamber 61. In the present arrangement the conduit 67 is cylindrical. That is, the outer surface 69 of the conduit 67 is cylindrical. However, it will be understood that the conduit 67 may converge towards the free end 68, or have an alternative configuration. The conduit 67 is heated by heat conducted from the heater (not shown).

The conduit 67 has an opening at its free end 68. The opening forms the cyclonic chamber outlet 63. In the present embodiment, the cyclonic chamber outlet 63 forms the end of the conduit 67, however it will be understood that the cyclonic chamber outlet 63 may be formed by at least one opening in the outer surface 69 of the conduit 67 proximate to or at the free end 68. The opening is circular. The cyclonic chamber outlet 63 defines a path through the conduit 67. The cyclonic chamber outlet 63 communicates with the outlet passage 80, acting as an outlet steam flow section. The outlet passage 80 communicates between the second steam flow section 60 and the steam vents (not shown).

The outlet passage 80 is formed by the soleplate 32. The outlet passage 80 is defined between the main body 38 and the ironing plate 39 of the soleplate panel 37. Therefore, steam flow from the second steam flow section 60 is simply provided to the steam vents (not shown). Furthermore, the outlet passage 80 is heated.

The cyclone chamber 61 acts as a fluid separator. The cyclone chamber 61 is configured to separate any water droplets, for example condensation, from steam flow by centrifugal force. Centrifugal force is caused by the inertia of a body; its resistance to change in its direction of motion. By providing a cyclonic steam path, any remaining water droplets are centrifugally urged against a peripheral sidewall of the second steam flow section. These may be smaller water droplets formed in the first steam flow section 50. Water droplets in contact with a surface of the cyclone chamber 61 may be evaporated by the heat of the surface. Dry steam, that is steam from which water droplets are at least substantially absent, is then able to flow through the cyclonic chamber outlet 63.

Use of the steam system iron 10 will now be described with reference to FIGS. 1 to 5. The user actuates the steam system iron 10 by operating the base user input 25. Water is fed to the steam generator 27 from the water reservoir 21 by the pump 22. The steam generator 27 is operated to evaporate the water into steam under pressure. The flow of steam from the steam generator 27 is controlled by the valve 23. The valve 23 is operable by the user input 34 on the steam iron head 30 so that a user is able to control the flow of steam through the steam vents (not shown). It will be understood that the valve 23 may be omitted, or steam flow may be controlled in an alternative manner.

The user is able to hold the steam iron head 30 by the handle 33 and manoeuvre the steam iron head 30 to a desired operating position, for example against a fabric to be treated. The hose 24 is flexible to allow movement of the steam iron head 24 relative to the base unit 20. When the valve 23 is opened, steam flows along the hose 24 to the steam iron head 30. Steam flows to the steam inlet 36. It has been found that steam may condense as it flows along the hose 24 so that water droplets are carried along with the steam flow.

Steam enters the steam pathway 40 through the steam inlet 36. The steam then flows into the first steam flow section 50 of the steam pathway 40. The steam flows in the first steam flow section 50 along an indirect flow path. The sidewalls 53 direct the fluid flow from the steam inlet 36 to the first steam flow section outlet 51. The indirect path defined in the first steam flow section 50 causes collision of fluid flowing along the flow path with at least one sidewall 53. As the steam flows along the steam path defined in the first steam flow section 50, the steam flow is forced to change direction. The lighter steam particles tend to change direction easier than heavier water droplets in the steam flow. The heavier water droplets therefore collide with the sidewalls 53. Water droplets impinge against the sidewalls 53 of the first steam flow section 50 and such water droplets are dispersed as smaller water droplets. Heat is also transferred to water droplets by the surface of the sidewalls 53 and so water droplets evaporate and rejoin the steam flow. The labyrinth configuration of the first steam flow section 50 helps cause multiple collisions of fluid flowing along the flow path with sidewalls 53.

Once steam has passed along the first steam flow section 50, the steam flows through the first steam flow section outlet 51 into the linking passage 70. The flow area of the linking passage 70 is less than the flow area of the first steam flow section 50. Therefore, the steam flow velocity is increased. The steam flow passes into the second steam flow section outlet 52 through the cyclonic chamber inlet 62. The steam flow enters into the cyclonic chamber 61 tangentially. That is, the flow of the fluid is tangential to the peripheral sidewall 65. The steam also enters at an inclined path due to the incline of the linking passage 70. The increased velocity of the steam flow entering the cyclonic chamber 61 maximises the centrifugal force acting on the flow.

The fluid entering the cyclonic chamber 61 is a mixture of steam and any remaining water droplets that were not evaporated in the first steam flow section 50. The cyclonic chamber inlet 62 introduces the fluid flow into the cyclonic chamber 61 through the peripheral sidewall 65. Therefore, fluid flow is required to change direction when it enters the cyclonic chamber 61 due to the frusto-conical arrangement of the cyclonic chamber 61.

As the fluid changes direction it resists the change to its state of motion. Particles with a larger mass, such as water droplets, resist the change to their state of motion more than particles with a smaller mass, such as steam particles. Therefore, the heavier water droplets resist the change in direction of the flow of the fluid more than the lighter steam particles. Consequently, the heavier water droplets move radially outwardly into contact with the peripheral sidewall 65 of the cyclonic chamber 61. Therefore, water droplets in the steam flow are urged away from cyclonic chamber outlet 63 and so do not pass to the steam vents (not shown). When water droplets come into contact with the peripheral sidewall 65, heat is transferred from the heated peripheral sidewall 65 therefore causing the water droplets to evaporate. This helps minimise water droplets in the steam flow. Furthermore, any water droplets that flow to the base 64 of the cyclonic chamber 61 due to gravity flow away from the cyclonic chamber outlet 63 and may be evaporated by the heated base 64.

The steam flow passes in a helical manner around the cyclonic chamber 61 and flows towards the upper end of the cyclonic chamber 61. The steam flow is then able to pass through the cyclonic chamber outlet 63 to flow to the steam vents (not shown). Steam passing through the cyclonic chamber outlet 63 is generally "dry" steam, that is say steam without water droplets carried therewith due to the combined effects of the first and second steam flow sections 50, 60. It has been found that the combination of the indirect path of the first steam flow section 50 and the cyclonic path of the second steam flow section 60 has a synergistic effect of removing water droplets from a steam flow passing along the steam pathway 40 from the steam inlet 36 to the steam vents. It has been found that the first steam flow section 50 breaks down larger water droplets, and that the second steam flow section 60 helps to ensure evaporation of any remaining water droplets. The steam is known as dry steam because all the water is in a gaseous state. That is, there is a minimal amount of water droplets present in the fluid.

Steam passing through the cyclonic chamber outlet 63 then flows to the steam vents (not shown) via the outlet passage 80. It will be understood that the outlet passage 80 is heated by the heater (not shown) and so the steam flowing therealong is restricted from condensing.

The dry steam, with minimal or no water droplets, is then discharged through the steam vents (not shown) and onto the fabric to be treated. The user manoeuvres the steam iron head 30 across the fabric to distribute the steam and remove wrinkles.

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the spirit and scope of the technique approaches of the present invention, which will also fall into the protective scope of the claims of the present invention. In the claims, the word "comprising" does not exclude other elements or steps, and the indefinite article "a" or "an" does not exclude a plurality. Any reference signs in the claims should not be construed as limiting the scope.

The invention claimed is:

1. A steam iron head, comprising:
a soleplate panel including
an ironing plate through which steam is discharged from the steam iron head, and
a main body having a base wall and a cover on the soleplate panel, the base wall and cover being separated by outer side walls and inner side walls extending therebetween to define a steam pathway from a stream inlet through a non-cyclonic first steam flow section and a cyclonic second steam flow section to the ironing plate;
wherein the non-cyclonic first steam flow section defines an indirect, non-cyclonic, flow path between the steam inlet and the cyclonic second steam flow section, said indirect flow path being formed by said inner side walls that act as baffles to direct fluid through the non-cyclonic first steam flow section along a labyrinthine path around the baffles and in a direction that remains parallel to the base wall and the cover; and
wherein the cyclonic second steam flow section; defines a cyclonic flow path between the non-cyclonic first steam flow section and the ironing plate.

2. The steam iron head according to claim 1, further comprising,
a heater configured to heat the steam pathway.

3. The steam iron head according to claim 2, wherein the heater is configured to maintain the steam pathway at a temperature at least above 100° C.

4. The steam iron head according to claim 1, wherein the cyclonic second steam flow section includes a cyclonic chamber.

5. The steam iron head according to claim 4, wherein the cyclonic chamber includes a base and a frusto-conical peripheral wall extending from the base.

6. The steam iron head according to claim 5, wherein the steam pathway is configured so that steam enters the cyclonic chamber in a direction orientated about 5 degrees to the base.

7. The steam iron head according to claim 6,
wherein the cyclonic second steam flow section further includes a cyclonic chamber inlet configured to direct steam tangentially into the cyclonic chamber.

8. The steam iron head according to claim 7, wherein the cyclonic second steam flow section further includes conduit upstanding in the cyclonic chamber having a cyclonic chamber outlet distal to the cyclonic chamber inlet.

9. The steam iron head according to claim 1, wherein the steam pathway further includes an intermediate steam flow section between the non-cyclonic first steam flow section and the cyclonic second steam flow section; and wherein at least part of the intermediate steam flow section has a flow area which is less than a flow area of the non-cyclonic first steam flow section so that the velocity of steam flow entering the cyclonic second steam flow section is greater than the velocity of steam flow in the non-cyclonic first steam flow section.

10. The steam iron head according to claim 1, wherein the soleplate panel further includes an outlet passage between the cyclonic second steam flow section and the ironing plate.

11. A steam system iron, comprising, the steam iron head according to claim 1.

12. The steam system iron according to claim 11, further comprising, a base unit having a steam generator; and a hose fluidly communicating the steam iron head with the steam generator.

* * * * *